United States Patent [19]

Suquet

[11] Patent Number: 4,944,281

[45] Date of Patent: Jul. 31, 1990

[54] CIRCUIT FOR REGULATING CURRENT IN AN INDUCTIVE LOAD

[75] Inventor: Michel Suquet, Cugnaux, France

[73] Assignee: Bendix Electronics S.A., Toulouse, France

[21] Appl. No.: 120,572

[22] Filed: Nov. 13, 1987

[30] Foreign Application Priority Data

Nov. 26, 1986 [FR] France ..... 86 16500

[51] Int. Cl.[5] ..... F02P 3/05; H01H 47/32

[52] U.S. Cl. ..... 123/644; 123/490; 315/209 T; 361/152; 361/154

[58] Field of Search ..... 123/644, 490; 315/209 T; 361/154, 152, 263

[56] References Cited

U.S. PATENT DOCUMENTS

| | | | |
|---|---|---|---|
| 3,549,955 | 12/1970 | Paine . | |
| 3,575,154 | 4/1971 | Taylor | 123/644 |
| 3,709,206 | 1/1973 | Myers | 123/644 |
| 4,244,344 | 1/1981 | Werner et al. | 123/644 |
| 4,290,406 | 9/1981 | Iyoda et al. | 123/644 |
| 4,473,861 | 9/1984 | Kosak et al. | 123/490 |
| 4,520,420 | 5/1985 | Ariyoshi et al. | 361/154 |
| 4,618,908 | 10/1986 | Anttila | 123/490 |
| 4,764,840 | 8/1988 | Petrie et al. | 123/490 |

FOREIGN PATENT DOCUMENTS

| | | |
|---|---|---|
| 0124239 | 11/1984 | European Pat. Off. . |
| 2330875 | 6/1977 | France . |
| 2024941 | 1/1980 | United Kingdom . |

OTHER PUBLICATIONS

Patent Abstracts of Japan, vol. 3, No. 4 (M-45), Jan. 17, 1979.

*Primary Examiner*—Andrew M. Dolinar

*Attorney, Agent, or Firm*—Russel C. Wells; George L. Boller

[57] ABSTRACT

The circuit according to the invention comprises a hysteresis comparator 9 connected to a transistor 2 controlling the current flowing in an inductive load 1. The voltage taken across the terminals of a measurement resistor 3 is compared with a reference voltage established by a source 6. According to the invention, a feedback loop 10 establishes a proportional action of the transistor 2 on the current in the load 1 when the voltage at S exceeds a predetermined threshold. In this way an oscillation is obtained between two values on either side of a nominal value, these two values being associated with the thresholds of the hysteresis comparator. Application to the production of an integrated circuit for the control of the ignition coil of an internal combustion engine.

7 Claims, 3 Drawing Sheets

(PRIOR ART)

CIRCUIT FOR REGULATING CURRENT IN AN INDUCTIVE LOAD

The present invention relates to a circuit for the regulation of current in an inductive load, designed for production as an integrated circuit. The invention also relates to such a circuit which has a particular application in the electronic control of an internal combustion engine ignition coil.

The regulation of the current in an inductive load occurs in numerous areas of technology such as, for example, the powering of electric motors, and, more particularly, in the field of the propulsion of motor vehicles by internal combustion engines, in the control of the supply of the ignition coils or of the solenoid valves of fuel injectors.

There then frequently arises the problem of limiting the power dissipated in an inductive winding during a permanent supply, in order, for example, to avoid excess heating or too high an electrical energy consumption capable of rapidly exhausting an on-board energy source, such as the battery of a motor vehicle.

Figure 1:
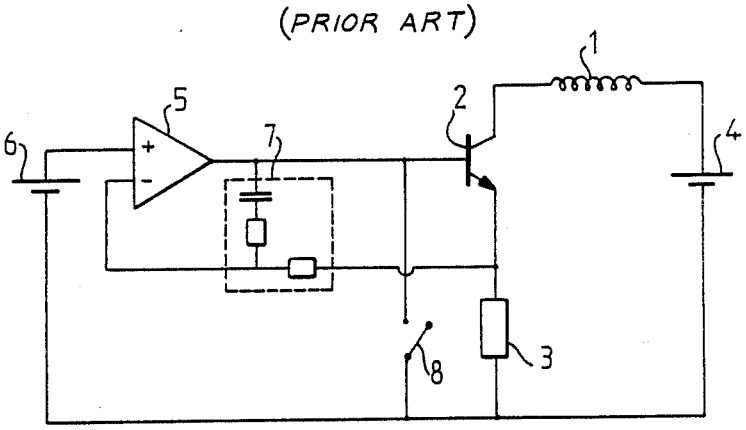

Traditionally, in order to limit the current in an inductive load, there is used a circuit such as that shown in FIG. 1 of the attached drawing, in which the inductive load 1 is connected in series with an electronic control device 2 such as a transistor, a measuring resistor 3 and an electrical energy source 4 supplying this circuit. One of the inputs of a differential amplifier 5 is fed from a reference voltage source 6, the other input of the amplifier being fed with the voltage taken across the terminals of the measurement resistor, a voltage whose amplitude represents the value of the current flowing in the inductive load 1. The output of the differential amplifier 5 supplies the base of the transistor 2 in order to control this transistor in such a way that the current flowing in the load and in the emitter-collector circuit of the transistor is regulated to the value corresponding with the chosen reference voltage. The current in the inductive load can be cut off by closing a switch 8 which connects the base of the NPN type transistor to ground.

The circuit thus comprises a feedback loop which slaves the current in the load to a chosen value. In order to ensure the stability of this loop, there is usually provided a corrector sub-circuit 7, installed between the output of the differential amplifier 5 and the input of this amplifier which is fed with the measurement signal. This corrector is traditionally constituted by an arrangement of resistors and capacitors chosen from various configurations that are well known in control loop technology. In certain applications, and this is particularly the case in circuits for the control of the ignition of internal combustion engines, these resistors and these capacitors have the disadvantage of having values that are too high to be able to be incorporated in an integrated circuit at reasonable cost.

It is therefore an object of the present invention to provide a circuit for the regulation of the current flowing in an inductive load which is easily integrable using the current integrated circuit manufacturing techniques of photo-chemical etching and the diffusion of impurities, for example.

Another object of the present invention is to provide such an integrable circuit, more particularly intended for the control of the current flowing in the coil of an electronic device for the control of the ignition of an internal combustion engine.

These objects of the invention are obtained with an integrable circuit for the regulation of the current flowing in an inductive load fed by a voltage source, comprising an electronic control device placed in series with this load and a comparator fed by a first signal representing a reference current value and by a second signal representing the instantaneous value of the current flowing in the load and in the electronic control device, of which one control electrode is connected to the output of the comparator, this circuit being characterized in that it comprises a feedback loop between the terminal common to the load and to the electronic control device, and the control electrode of this device, capable of controlling a proportional conduction of the device when the voltage on the said common terminal reaches a predetermined threshold, this conduction being substituted for the saturation conduction of the electronic device established by the comparator, when the voltage at the common terminal is lower than the predetermined threshold, in such a way as to make the value of the current in the load oscillate about a nominal value.

Figure 2:
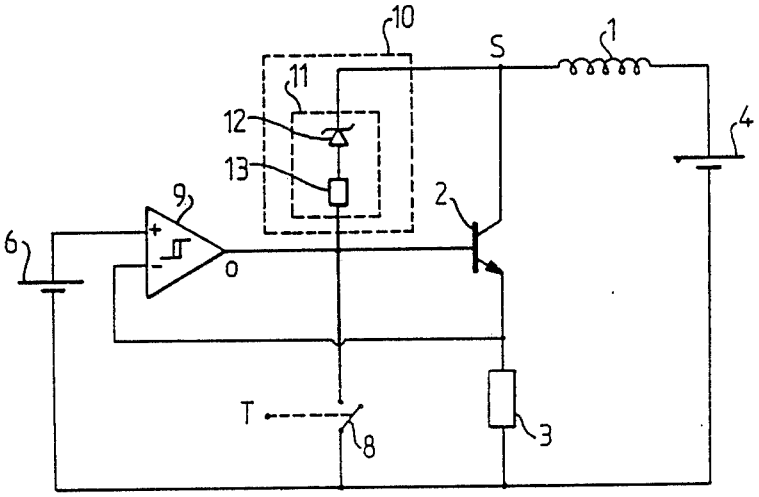
Figure 2A:
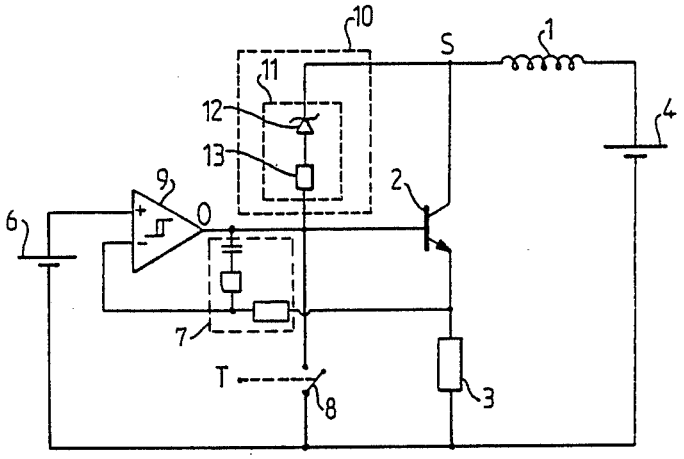

The invention will now be described by way of example with reference to the accompanying drawings in which:

FIG. 1 is a diagrammatic representation of a circuit for the regulation of the current in an inductive load according to the prior art, FIG. 2 is a diagrammatic representation of the regulating circuit according to the present invention, FIG. 2A is a circuit like FIG. 2, but includes a loop stability corrector network.

Figure 5:
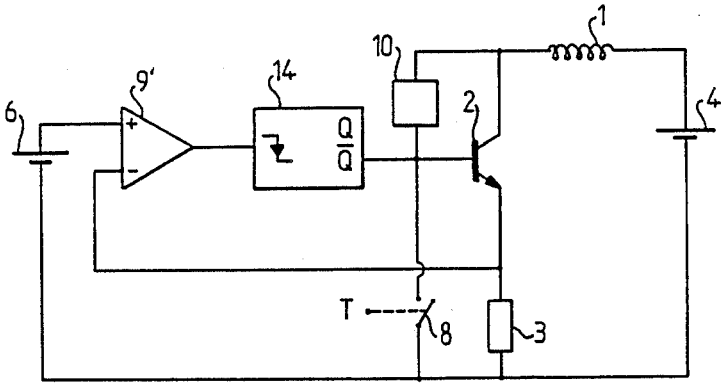
Figure 3:
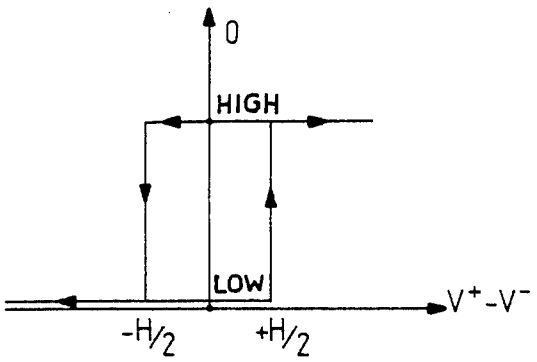

FIG. 3 is a graph showing the transfer characteristic of a hysteresis comparator which is part of the circuit in FIG. 2, FIGS. 4A and 4B are graphs showing the variation of the current in the inductive load and that of the voltage at point S in the circuit according to the invention respectively, and FIG. 5 is a diagrammatic representation of a second embodiment of the circuit according to the present invention.

Figure 6:
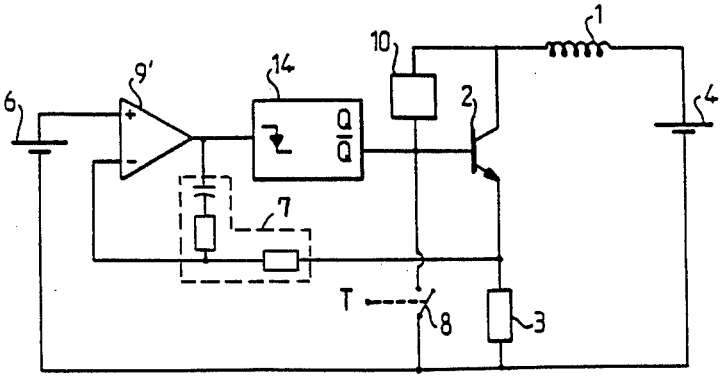

FIG. 6 is a circuit like FIG. 5 with a loop stability corrector network.

Before giving a detailed description of the circuit according to the invention, it is helpful to recall some characteristics of a particular, but not limiting, application of the invention, namely the regulation of the current in a coil of an electronic ignition device of an internal combustion engine. In this application a current must be made to flow in the coil for a period of time that is sufficient to charge the coil with a predetermined electromagnetic energy which is then suddenly released by opening the coil supply circuit, which causes the emission of an ignition spark in a spark plug forming part of a secondary circuit coupled to the coil by mutual inductance. The emission of this spark is triggered at a specified ignition advance time calculated as a function of certain engine operating parameters (speed of rotation, induction pressure, etc . . . ). It is of course necessary at this time for the ignition coil to be sufficiently charged by the current having passed through the coil prior to this time and after the emission of the last spark. On closing the supply circuit, this current first increases to a predetermined value and must then be stabilized up to the discharge of the coil, in order to avoid the coil from being subjected to an excessive and useless heating starting from the moment at which the energy stored in the coil is sufficient to enable the triggering of an ignition spark of suitable energy. The present invention, in its application to the control of the ignition of an internal combustion engine, is applied to the stabilization of the current in the time interval known as the "regulation time" which precedes the moment of ignition.

Reference is now made to FIG. 2 of the drawing in which the numerical references 1,2,3,4 and 8 correspond with the corresponding units or components of the circuit according to the invention which are identical with those of the circuit of FIG. 1, mentioned in the preamble to the present description, a circuit in which the electronic control device takes the form of an NPN transistor 2.

In this figure, it appears that the control electrode of this device, the base of the transistor 2 in this case, is controlled by the output of a hysteresis comparator 9, whose transfer characteristic is shown in FIG. 3. The positive input of the comparator is connected to the reference voltage source 6, of value Uo, while the negative input is fed with the voltage taken across the measurement resistor 3. According to the invention, an additional feedback loop 10 makes the collector voltage of transistor 2 react on the base of this transistor, in order to re-establish the conduction of this transistor when this voltage exceeds a predetermined threshold.

Figure 4:
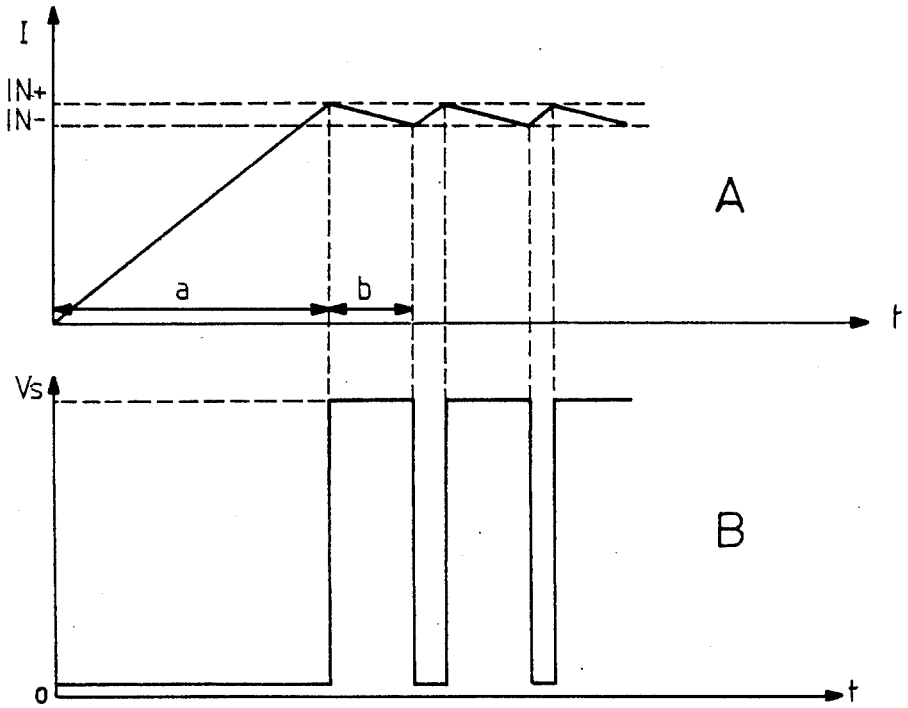

Reference is now made to FIGS. 3 and 4 in order to explain the functioning of the regulation circuit according to the invention.

When switch 8 is opened, the comparator sends a "high" (FIG. 3) signal to the base of the transistor 2 and this switches the transistor into its conducting state. The current I in the load 1, the transistor 2 and the measurement resistor then begins to increase (Section a of the graph I=f(t) of FIG. 4A). The voltage drop across the terminals of the measurement resistor then increases until it exceeds a value Uo+H/2 corresponding with the passing of the "low" switching threshold−H/2 of the comparator 9 (FIG. 3). In fact, at the moment of transition, the potential difference between the positive and negative inputs of the comparator is:

$$V^{+}-V^{-}=Uo-(Uo+H/2)=-H/2$$

At this moment, the current in the inductive load reaches a value IN+ (FIG. 4A). The switching of the output O of the comparator to the "low" state then cuts off the transistor 2. This immediately results in an overvoltage at S, on the collector of the transistor. According to the present invention, this overvoltage then establishes a proportional conduction of the transistor 2, by means of the feedback loop 10 which includes a device 11 sensitive to this overvoltage. In a first embodiment of the invention, this device 11 is constituted by a reverse-connected Zener diode 12 and a resistor 13 in series. When the overvoltage at S is such that the breakdown voltage of the diode is exceeded, a voltage is transmitted to the base of transistor 2 which then conducts again.

In a second embodiment, the device 11 is constituted by a resistor which conducts a current which will switch on the transistor 2 when the voltage at S reaches a predetermined threshold.

The conduction of transistor 2 makes the voltage at S and the current I in the inductive load 1 (phase b in the graph I=f(t) of FIG. 4A) decrease. When I becomes lower than the value IN− which corresponds with a voltage drop Uo−H/2 in the measurement resistor, there is again a switching of the hysteresis comparator 9, whose output returns to the "high" state in order to saturate the transistor (2) and thus cause the current in the inductive load 1 to rise again.

In stabilized operation, the current in the load (1) and in the transistor (2) therefore oscillates between the values IN+ and IN− while the voltage Vs at S oscillates between a controlled overvoltage close to the voltage E provided by the source 4 and a value very close to zero (FIG. B). It is possible to choose a hysteresis comparator 9 in which the thresholds −H/2 and +H/2 are very close, which produces a quasi-stabilization of the current in the load.

It is of course necessary to ensure the stability of the feedback loop 10 which enables this result to be achieved. According to a particularly advantageous feature of the present invention, the capacitors and resistors of the correction network (not shown) used for this purpose have much lower values than those of the corresponding components necessary in the circuit of the prior art shown in FIG. 1. In fact, the critical frequency of the loop 10 is much higher than that of the loop in FIG. 1. For example, in an application of the invention to the regulation of a current in an ignition coil of an internal combustion engine, a critical frequency in the order of 2 MHz has been noted, compared with a critical frequency of about 30 kHz for the loop of a circuit of the type shown in FIG. 1. The time constants of the correction network associated with the loop 10 and the values and sizes of the resistive and capacitive components used in this network are therefore much smaller. Because of this, they can easily be included in an integrated production of the circuit according to the invention, which is an essential object of the present invention. In certain applications, it will even be possible to dispense with the use of a corrector network. This will be the case, for example, when the overvoltage in phase b (FIG. 4) does not have to be controlled accurately. The gain of the loop 10 can then be small and not require a correction network FIG. 2A shows the circuit with a loop stability corrector network.

In the limit, it will be possible to obtain a nonoscillating current in the inductive load. For example, in the case of the control of the current in an ignition coil of an internal combustion engine, it can be arranged that the duration of phase b (FIG. 4) is longer than the regulation time required by the current. This can be obtained with a loop 10 such that the restart conduction threshold V of transistor 2 is sufficiently close to the value E−Rc.I, where Rc is the resistance of the inductive load 1 and E is the supply voltage, the equality leading to a phase b of infinite duration.

According to another embodiment of the invention, shown in FIG. 5, the hysteresis comparator 9 is replaced by a traditional comparator 9' whose output supplies a monostable flip-flop 14 of period To, the output $\overline{Q}$ of this flip-flop being connected to the base of the transistor 2. Thus, the transistor functions as a proportional action voltage limiter each time that the current exceeds the nominal current, during a time interval To. At the end of this interval, the transistor 2 is again saturated while the current I again drops below the nominal current. FIG. 6 shows the circuit with a loop stability corrector network.

Whatever embodiment of the circuit according to the invention is chosen, the current in the inductive load 5 can be interrupted at any time in order to create an overvoltage at the terminals of this load by closing the switch 8 connected between the ground of the circuit and the base of the NPN transistor 2, under the control of a signal T for example. It is of course necessary for the input impedance of the feedback loop 10 of the circuit to be suitably chosen in order not to prevent and to withstand this overvoltage without damage.

Thus, in an automobile electronics application of the circuit according to the invention, an overvoltage can be caused, at a predetermined time, across the inductive load (5). When this is coupled by mutual inductance to a secondary circuit including a spark plug forming part of an internal combustion engine, the closing of the switch 8 results in the generation of an ignition spark in this spark plug.

The circuit according to the invention also enables the obtaining of a stabilization and then a rapid cut-off of the current in the winding of an electro-magnet, such as that traditionally found in a fuel injector solenoid valve for an internal combustion engine.

The aforementioned applications of the invention are of course not limiting. On the contrary, the invention can be applied wherever it is necessary to regulate the current flowing in an inductive load, as is also the case, for example, in the control of the windings of electric motors. The invention also applies to all applications where the regulated current in the inductive load must be able to be cut off suddenly, as is practiced in the functioning of certain electro-magnets where a rapid demagnetization is a condition for obtaining short response times.

It is clear that the invention is not limited to a circuit for the regulation of current where the electronic control device takes the form of a transistor produced in bipolar technology. The use of MOS or CMOS technology is, for example, particularly suited for the integration of the circuit according to the invention.

I claim:

1. Circuit for the regulation of the current flowing in an inductive load fed by a voltage source, comprising:

an electronic control device having a control electrode and input and output electrodes placed in series with the load;

a comparator having a first signal representing a reference current value connected to one input and a second signal representing the instantaneous value of the current flowing in the load and in said electronic control value connected to a second input and its output connected to said control electrode;

said comparator has a hysteresis type transfer characteristic, wherein the thresholds $-H/2$ and $+H/2$ define the transitions of the electronic control device to the cut-off state or to the saturation conducting state, to oscillate the current in the load between two values that are closely above and closely below the nominal current to be established in the load; and a feedback loop operatively connected between a terminal common to the load and to said device, and said control electrode, said feedback loop coacting with said comparator, for controlling a proportional conduction of said device when the voltage at said common terminal reaches a predetermined threshold for oscillating the current in the load about a nominal value and a loop stability corrector network.

2. Circuit according to claim 1, characterized in that said feedback loop means comprises a resistor.

3. Circuit according to claim 1, characterized in that said feedback loop means comprises a reversed biased Zener diode in series with a resistor.

4. Circuit for the regulation of the current flowing in an ignition coil fed by a voltage source, comprising:

an electronic control device having a control electrode and input and output electrodes placed in series with the ignition coil;

a comparator having a first signal representing a reference current value connected to one input and a second signal representing the instantaneous value of the current flowing in the ignition coil and in said electronic control device connected to a second input and its output connected to said control electrode; and a feedback loop operatively connected between a terminal common to the ignition coil and to said device, and said control electrode, said feedback loop comprising a reversed biased Zener diode in series with a resistor, coacting with said comparator, for controlling a proportional conduction of said device when the voltage at said common terminal reaches a predetermined threshold for oscillating the current in the ignition coil about a nominal value and a loop stability corrector network.

5. Circuit according to claim 4, additionally including a multivibrator means connected between the output of said comparator and the control electrode of said electronic control device, said electronic control device returning the current in the ignition coil to its nominal value each time that the current in the ignition coil exceeds the value of the nominal current, during the time interval of said multivibrator means.

6. Circuit according to claim 5, wherein said multivibrator means is a monostable multivibrator and the predetermined time interval is the period of said monostable multivibrator.

7. Circuit according to claim 4 characterized in that said comparator has a hysteresis type transfer characteristic, wherein the thresholds $-H/2$ and $+H/2$ define the transitions of the electronic control device to the cut-off state of the saturation conducting state, to oscillate the current in the ignition coil between two values that are closely above and closely below the nominal current to be established in the ignition coil.

* * * * *